US009840397B2

(12) United States Patent
Zapf et al.

(10) Patent No.: US 9,840,397 B2
(45) Date of Patent: Dec. 12, 2017

(54) ELEVATOR INSTALLATION

(71) Applicant: Inventio AG, Hergiswil (CH)

(72) Inventors: Volker Zapf, Obernau (CH); Florian Dold, Root (CH); Philipp Bürgi, Berlin (DE)

(73) Assignee: INVENTIO AG, Hergiswil (CH)

( * ) Notice: Subject to any disclaimer, the term of this patent is extended or adjusted under 35 U.S.C. 154(b) by 70 days.

(21) Appl. No.: 14/648,273

(22) PCT Filed: Nov. 27, 2013

(86) PCT No.: PCT/EP2013/074836
§ 371 (c)(1),
(2) Date: May 29, 2015

(87) PCT Pub. No.: WO2014/083043
PCT Pub. Date: Jun. 5, 2014

(65) Prior Publication Data

US 2015/0307323 A1 Oct. 29, 2015

(30) Foreign Application Priority Data

Nov. 29, 2012 (EP) ..... 12194892

(51) Int. Cl.
*B66B 7/08* (2006.01)
*B66B 7/06* (2006.01)

(52) U.S. Cl.
CPC ..... *B66B 7/085* (2013.01); *B66B 7/062* (2013.01)

(58) Field of Classification Search
CPC ..... B66B 7/085; B66B 7/062
USPC ..... 187/411
See application file for complete search history.

(56) References Cited

U.S. PATENT DOCUMENTS

| | | | | |
|---|---|---|---|---|
| 6,256,841 | B1 * | 7/2001 | Ericson | B66B 7/085 24/136 R |
| 2002/0154944 | A1 * | 10/2002 | Traktovenko | B66B 7/085 403/347 |
| 2006/0054468 | A1 * | 3/2006 | Ach | B66B 7/085 198/844.2 |
| 2007/0017749 | A1 | 1/2007 | Dold et al. | |
| 2007/0034454 | A1 * | 2/2007 | Dold | B66B 7/062 187/411 |

(Continued)

FOREIGN PATENT DOCUMENTS

| | | | | |
|---|---|---|---|---|
| EP | 2053007 | A1 | 4/2009 | |
| HU | FR 2293392 | A1 * | 7/1976 | B66B 7/085 |
| WO | 0151400 | A1 | 7/2001 | |

*Primary Examiner* — Michael Riegelman
(74) *Attorney, Agent, or Firm* — William J. Clemens; Schumaker, Loop & Kendrick, LLP

(57) ABSTRACT

An elevator installation has a car at least partially supported by a support including several electrically conductive tension-bearing elements, which elements are arranged parallel to each other and which are substantially surrounded by a jacket. The support is fastened to fastening devices, wherein the fastening devices each include a housing and a clamping element. The housing and the clamping element each have clamping surfaces, between which surfaces the support is clamped. An electrically insulating material is arranged between at least one side of the support and the clamping surfaces arranged thereon. The electrically insulating material electrically isolates the support from the housing or the clamping element or both.

17 Claims, 2 Drawing Sheets

(56) References Cited

U.S. PATENT DOCUMENTS

| | | | | |
|---|---|---|---|---|
| 2008/0282512 | A1* | 11/2008 | Ach | B66B 7/085<br>24/136 R |
| 2011/0042170 | A1 | 2/2011 | Faletto | |
| 2014/0182975 | A1* | 7/2014 | Ikonen | B66B 5/0031<br>187/251 |

* cited by examiner

ELEVATOR INSTALLATION

FIELD

The subject of the invention is an elevator installation and, in particular, a design of a fastening of support means in the elevator installation.

BACKGROUND

Belt-like support means are used in many elevator installations. Such support means generally comprise a plurality of tensile carriers which consist of steel wires and which absorb the tension forces to be accepted by the support means. The tensile carriers are in general surrounded by a casing of synthetic material.

Such support means are a safety-relevant component within an elevator installation. For this reason, use is made of checking units in elevator installations which check, in particular, the mechanical state of the tensile carriers. Damage to the tensile carriers absorbing the forces shall thereby be able to be recognized in good time. The support means can thus be exchanged in the event of damage so as to prevent failure of the elevator installation.

The electrically conductive tensile carriers are surrounded by the electrically insulating casing of synthetic material. In order to carry out a check of the state of the tensile carriers electrical contact is usually made with the tensile carriers and, with the help of an electrical test current conducted through the tensile carriers, the state of the tensile carriers is ascertained. In that case, changes, especially an increase in the electrical resistance of the tensile carriers, indicate deterioration of the state of the tensile carriers. In order to be able to reliably check the individual tensile carriers it is important that the tensile carriers are not in electrical contact with one another. Such electrical short-circuits between tensile carriers of a support means can arise at, for example, locations at which the support means is clamped in place.

SUMMARY

An object of the present invention consists of providing an elevator installation in which there is reliable prevention of encased tensile carriers of the support means from being electrically short-circuited with one another. In addition, the elevator installation shall be economic and simple to install.

An elevator installation with a car and a support means is proposed for fulfilment of this object. In that case the car is supported at least partly by the support means. The support means comprises a plurality of electrically conductive tensile carriers which are arranged parallel to one another and which are substantially encased by a casing. The support means has a first side and a second side. The support means is fastened to support means fastening devices, wherein the support means fastening devices each comprise a housing and a clamping element. The housing and the clamping element have clamping surfaces between which the support means is clamped in place. In that case, an electrically insulating material which electrically separates the support means from the housing or the clamping element is arranged at least between one side of the support means and the clamping surfaces arranged thereat.

Such an elevator installation has at the outset the advantage that conventional wedge locks can be used as support means fastening devices. The conventional support means fastening devices and the support means placed therein are supplemented merely by the electrically insulating material.

It is thereby ensured that, in the case of possible contact between the tensile carriers and the support means fastening device, electrical bridges between the tensile carriers do not arise and earthing of the tensile carriers by way of the support means fastening device does not occur. The tensile carriers of the support means thus remain electrically insulated from one another even if the casing on one side of the support means is worn through. Such an electrically insulating material is economic to produce and simple to install in an elevator installation. In addition, existing elevator installations can be retrofitted with such electric insulating material.

In an advantageous embodiment the first side of the support means is a traction side which is in contact with a drive pulley of a drive. The second side of the support means is a rear side. In that case the electrically insulating material is arranged between the rear side of the support means and the housing or the clamping element. An arrangement of that kind of the electrically insulating material is advantageous because it has been observed that the casing, which is usually formed to be thinner, on the rear side of the support means wears through more quickly than the casing, which is usually formed to be thicker, on the traction side of the support means. Thus, in this embodiment it is sufficient to electrically isolate merely one side of the support means from the support means fastening device by the electrically insulating material.

In a further advantageous embodiment an electrically insulating material is arranged between the two sides of the support means and the housing or the clamping element. Such an arrangement is advantageous if it is anticipated that either the casing on the rear side of the support means or the casing on the traction side of the support means could be damaged in use.

In an advantageous form of embodiment longitudinal ribs are formed on the traction side of the support means. Such longitudinal ribs have the advantage that traction between the support means and a drive pulley is increased and that, in addition, wearing through of a casing on the traction side as far as the tensile carriers is effectively prevented.

The electrically insulating material can be constructed in various forms and ways. It can be constructed as, for example, a continuous layer or, however, as pieces distributed on a surface. In that case it is essential that the support means or the tensile carriers are effectively electrically insulated from the clamping surfaces.

In an advantageous embodiment the electrical insulating material is constructed as a film. In an advantageous development the film is laid and clamped in place between the support means and the housing or the clamping element. Such a film has the advantage that it can be easily retrofitted in existing elevator installations and that it does not oblige any change in manufacture of the support means fastening device.

In an alternative advantageous embodiment the electrically insulating material is constructed as an adhesive tape. In an advantageous development the adhesive tape is glued onto the support means and/or onto the housing or the clamping element. Such an adhesive tape similarly has the advantage that it can be retrofitted in already existing elevator installations in simple mode and manner. In addition, an adhesive tape offers the advantage that the electrically insulating material at the time of installing the elevator installation can less easily slip away from its intended position.

In a further advantageous embodiment the electrically insulating material is constructed as a coating. In an advantageous development the coating is coated on the housing or the clamping element. Such a coating has the advantage that it always remains at its intended position and that no separate installation steps at the time of installing the elevator are necessary for that purpose. Consequently, fewer errors can arise when the elevator installation is installed. A coating additionally has the advantage that surface characteristics can be selected independently of the material of the support means fastening device. Thus, for example, a coating material can be selected which has a different surface roughness than the support means fastening device without a coating.

In an advantageous development the coating is a powder coating or a wet lacquer or a ceramic coating or an enamelling or a Teflon (polytetrafluoroethylene available from DuPont Co.) coating. The form of coating can be selected or adapted as a function of the respective qualities of the elevator installation, the support means and the support means fastening device.

In an advantageous embodiment the coating has a layer thickness of 5 to 1000 micrometers, preferably from 10 to 500 micrometers, particularly preferably 15 to 300 micrometers. In that case, depending on the respective kind of coating a smaller or larger layer thickness can be required in order to guarantee the desired electrically insulating function in all circumstances.

In an advantageous form of embodiment the clamping element is constructed as a wedge. In an alternative embodiment the clamping element is of different form, for example with a circular, oval, polygonal or irregularly shaped cross-section. The clamping element in that case does not necessarily have to be constructed as a body with a constant cross-section; bodies of different shapes also be used as clamping elements.

DESCRIPTION OF THE DRAWINGS

Details and advantages of the invention are described in the following by way of embodiments and with reference to the schematic drawings, in which.

DETAILED DESCRIPTION

Figure 1:
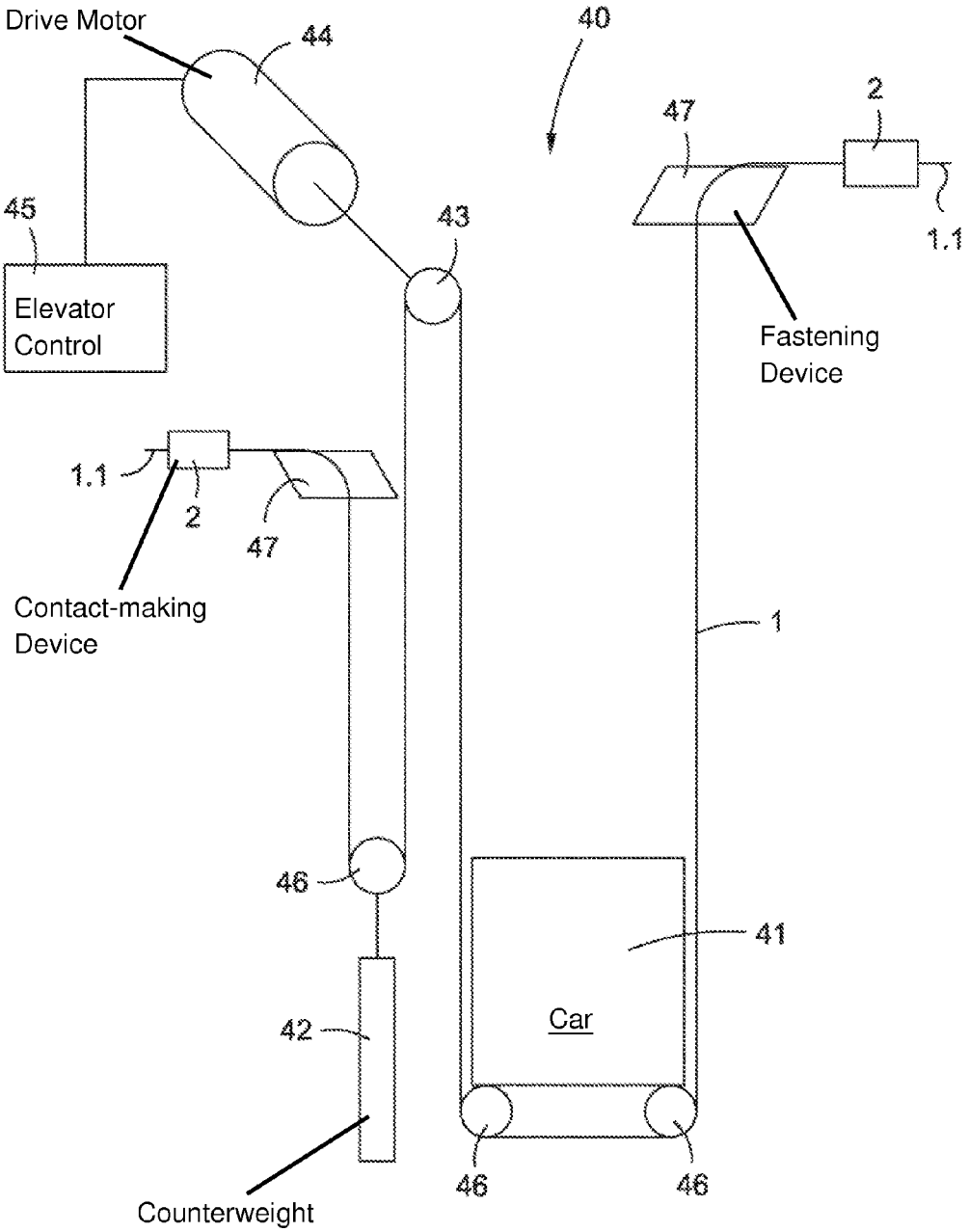
FIG. 1 shows an exemplifying form of embodiment of an elevator installation.

The elevator installation 40 illustrated schematically and by way of example in FIG. 1 includes an elevator car 41, a counterweight 42 and a support means 1 as well as a drive pulley 43 with associated drive motor 44. The drive pulley 43 drives the support means 1 and thus moves the elevator car 41 and the counterweight 42 in opposite sense. The drive motor 44 is controlled by an elevator control 45. The car 41 is designed to receive persons and/or goods and to transport them between floors of a building. The car 41 and counterweight 42 are guided along guides (not illustrated). In the example, the car 41 and the counterweight 42 are each suspended at support rollers 46. The support means 1 is in that case fixed to a first support means fastening device 47 and then initially guided around the support roller 46 of the counterweight 42. The support means 1 is then laid over the drive pulley 43, guided around the support roller 46 of the car 41 and finally connected with a fixing point by a second support means fastening device 47. This means that the support means 1 runs by way of the drive 43, 44 at a speed which, in accordance with a suspension factor, is higher than the car 41 or counterweight 42 moves. In the example the suspension factor is 2:1.

A free end 1.1 of the support means 1 is provided with a contact-making device 2 for temporary or permanent contacting and monitoring of the support means 1. In the illustrated example a contact-making device 2 of that kind is arranged at both ends of the support means 1. In an alternative form of embodiment (not illustrated) only one contact-making device 2 is arranged at one of the support means ends 1.1. The support means ends 1.1 are no longer loaded by the tension force of the support means 1, since this tension force has already been conducted beforehand by way of the support means fastening devices 47 into the building. The contact-making devices 2 are thus arranged in a region, which is not rolled over, of the support means 1 and outside the loaded area of the support means 1.

The illustrated elevator installation 40 in FIG. 1 is by way of example. Other suspension factors and arrangements such as, for example, elevator installations without a counterweight are possible. The contact-making device 2 for contacting the support means 1 is then arranged in correspondence with the positioning of the support means fastening devices 47.

Figure 2:
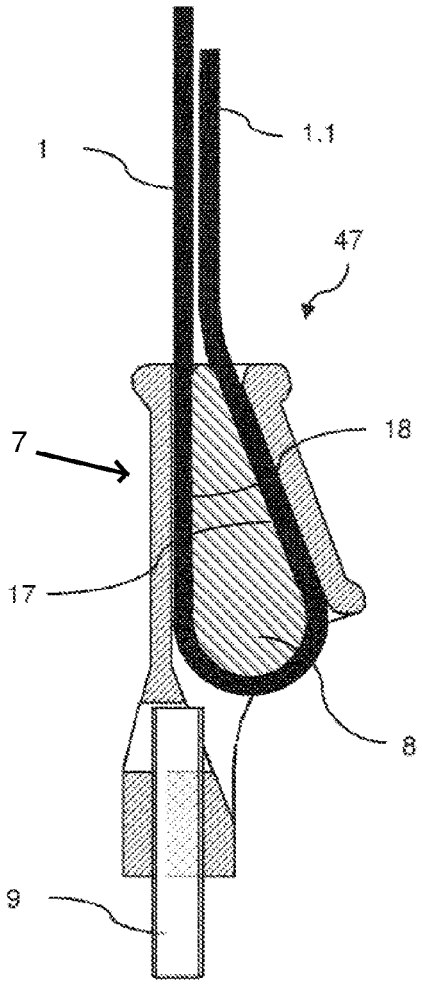
FIG. 2 shows an exemplifying form of embodiment of a support means fastening device.

An exemplifying form of embodiment of a support means fastening device 47 with support means 1 inserted therein is illustrated in FIG. 2. The support means fastening device 47 comprises a housing 7 and a clamping element 8 arranged therein. The housing is fastened to an element in the elevator installation by way of a threaded rod 9. The support means fastening device 47 can be connected by way of the threaded rod 9 with, for example, a car, a counterweight or a support.

The support means 1 inserted into the support means fastening device 47 has a loaded side and a free support means end 1.1. The support means 1 is clamped in place in the support means fastening device 47 by clamping surfaces 17, 18 of the clamping element 8 and the housing 7.

Figure 3A:
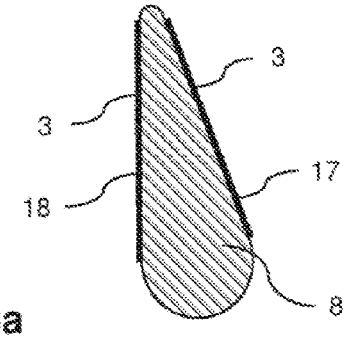
FIG. 3*a* shows an exemplifying form of embodiment of a housing of a support means fastening device.
Figure 3B:
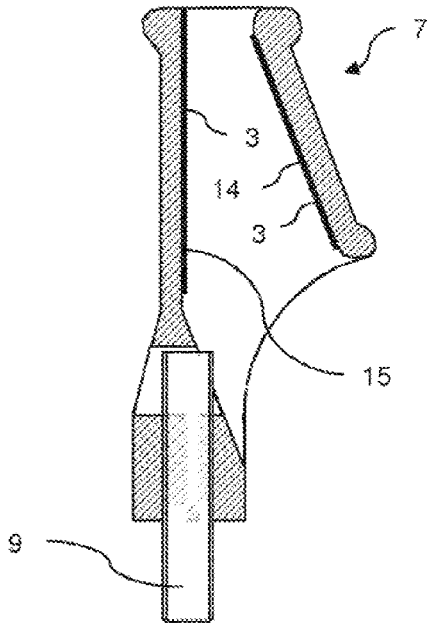
FIG. 3*b* shows an exemplifying form of embodiment of a clamping element of a support means fastening device.

A clamping element 8 and a housing 7 are illustrated in FIGS. 3*a* and 3*b*. The clamping surfaces 17, 18 of the clamping element 8 and the clamping surfaces 14, 15 of the housing 7 are in that case coated with the electrically insulating material 3.

The electrically insulating material 3 is thus arranged between at least one side of the support means 1 and the clamping surfaces 14, 15, 17, 18 arranged thereat. The electrically insulating material 3 can therefore be arranged—in a first embodiment (not illustrated)—between the support means and the clamping surfaces 17, 18 of the clamping element 8, or—in a second embodiment (similarly not illustrated)—between the support means 1 and the clamping surfaces 14, 15 of the housing 7—or in a third embodiment, which is illustrated in FIGS. 3*a* and 3*b*—between the support means 1 and the clamping surfaces 14, 15, 17, 18 of the housing 7 and the clamping element 8. The electrically insulating material 3 thus separates the at least one side of the support means 1 from the housing 7 or the clamping element 8.

Figure 4:
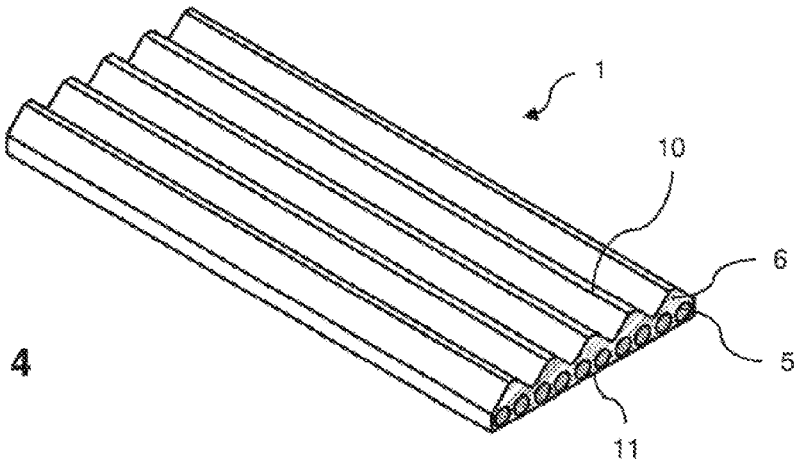
FIG. 4 shows an exemplifying form of embodiment of a support means.

An exemplifying form of embodiment of a support means 1 is illustrated in FIG. 4. The support means 1 comprises a plurality of mutually parallel electrically conductive tensile carriers 5 encased by a casing 6. The support means 1 has a first side 10 and a second side 11. In that instance the first side 10 of the support means 1 is formed as a traction side disposed in contact with a drive pulley of a drive. The second side 11 of the support means 1 is formed as a rear side. In this embodiment the traction side 10 has longitudinal ribs. Such longitudinal ribs serve on the one hand for improved traction of the support means 1 on the drive pulley and on the other hand for increased protection of the tensile carriers 5.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation having a car at least partly supported by a support including a plurality of electrically conductive tensile carriers arranged parallel to one another and substantially encased by a casing, the support having a first side and a second side, the support being fastened to support fastening devices, the support fastening devices each comprising:

a housing having housing clamping surfaces;

a clamping element having clamping element clamping surfaces wherein the support is clamped between the housing clamping surfaces and the clamping element clamping surfaces; and an electrically insulating material arranged at the housing clamping surfaces and the clamping element clamping surfaces to electrically separate the support from the housing and the clamping element.

2. The elevator installation according to claim 1 wherein the first side of the support is a traction side that is in contact with a drive pulley of a drive, wherein the second side of the support is a rear side and wherein the electrically insulating material is arranged between the rear side and one of the housing clamping surfaces and the clamping element clamping surfaces.

3. The elevator installation according to claim 2 wherein longitudinal ribs are formed on the traction side of the support.

4. The elevator installation according to claim 1 wherein the electrically insulating material is arranged between the first and second sides of the support and the clamping surfaces of the housing and the clamping element.

5. The elevator installation according to claim 1 wherein the electrically insulating material is formed as a film.

6. The elevator installation according to claim 5 wherein the film is inserted and clamped in place between the support and the clamping surfaces of at least one of the housing and the clamping element.

7. The elevator installation according to claim 1 wherein the electrically insulating material is formed as an adhesive tape.

8. The elevator installation according to claim 7 wherein the adhesive tape is glued to at least one of the support and the clamping surfaces.

9. The elevator installation according to claim 1 wherein the electrically insulating material is formed as a coating.

10. The elevator installation according to claim 9 wherein the coating is coated on at least one of the housing clamping surfaces and the clamping element clamping surfaces.

11. The elevator installation according to claim 9 wherein the coating is one of a powder, a wet lacquer, a ceramic, an enamelling and a polytetrafluoroethylene material.

12. The elevator installation according to claim 9 wherein the coating has a layer thickness of 5 to 1,000 micrometers.

13. The elevator installation according to claim 9 wherein the coating has a layer thickness of 10 to 500 micrometers.

14. The elevator installation according to claim 9 wherein the coating has a layer thickness of 15 to 300 micrometers.

15. The elevator installation according to claim 1 wherein the clamping element is formed as a wedge.

16. A support fastening device for an elevator installation having support belt, the support fastening device comprising:

a housing having clamping surfaces;

a clamping element having clamping surfaces, the support belt being clamped between the clamping surfaces of the housing and the clamping element; and an electrically insulating material coating the clamping surfaces of the housing and the clamping element wherein during use of the support belt the support belt is electrically insulated from the housing and the clamping element by the electrically insulating material.

17. The support fastening device according to claim 16 wherein the coating is one of a powder, a wet lacquer, a ceramic, an enamelling and a polytetrafluoroethylene material.

* * * * *